US008221016B2

(12) United States Patent
Andersen et al.

(10) Patent No.: US 8,221,016 B2
(45) Date of Patent: Jul. 17, 2012

(54) DEVICE AND A METHOD FOR DOSAGE OF FLUIDS

(75) Inventors: Tom Juul Andersen, Roskilde (DK); Bo Boye, Birkerød (DK)

(73) Assignee: Idekontoret Aps, Roskilde (DK)

( * ) Notice: Subject to any disclaimer, the term of this patent is extended or adjusted under 35 U.S.C. 154(b) by 1129 days.

(21) Appl. No.: 11/666,857

(22) PCT Filed: Nov. 3, 2005

(86) PCT No.: PCT/DK2005/000701

§ 371 (c)(1),
(2), (4) Date: Apr. 14, 2008

(87) PCT Pub. No.: WO2006/048018

PCT Pub. Date: May 11, 2006

(65) Prior Publication Data

US 2008/0279614 A1 Nov. 13, 2008

(30) Foreign Application Priority Data

Nov. 4, 2004 (DK) ..... 2004 01694

(51) Int. Cl.
*B43K 8/06* (2006.01)

(52) U.S. Cl. ..... 401/198; 401/195; 239/86; 239/104; 239/114; 239/123; 239/145; 47/81

(58) Field of Classification Search ..... 401/195, 401/198; 239/86, 104, 106, 107, 114, 123, 239/145, 326, 327, 533.1, 533.13, 589, 602; 47/81

See application file for complete search history.

(56) References Cited

U.S. PATENT DOCUMENTS

| | | | | |
|---|---|---|---|---|
| 2,747,332 | A | 5/1956 | Morehouse | |
| 3,786,598 | A | 1/1974 | Stadelhofer | |
| 4,117,631 | A | 10/1978 | Tull et al. | |
| 805,343 | A | 2/1989 | Patterson et al. | |
| 4,819,375 | A | 4/1989 | Baumgartner et al. | |
| 4,977,785 | A * | 12/1990 | Willoughby et al. | 239/86 |
| 6,321,487 | B1 | 11/2001 | Sardanelli et al. | |
| 7,225,998 | B2 * | 6/2007 | Pellizzari | 239/104 |
| 7,347,345 | B2 * | 3/2008 | Guerrero et al. | 239/106 |

FOREIGN PATENT DOCUMENTS

| | | |
|---|---|---|
| DE | 183 168 | 4/1907 |
| DE | 24 47 230 | 10/1974 |
| DE | 24 47 230 | 4/1976 |
| FR | 1 217 816 A | 5/1960 |
| FR | 2088860 | 4/1970 |
| FR | 2 088 860 | 1/1972 |
| WO | WO 03/096796 A1 | 5/2003 |

* cited by examiner

*Primary Examiner* — Steven J Ganey
(74) *Attorney, Agent, or Firm* — Harness, Dickey & Pierce, P.L.C.

(57) ABSTRACT

A device and a method for continuous and adjustable dosage of fluids at low pressure. The invention is self-cleaning and low tech. It consists of a tapering dosage unit in which a filling, which allows fluids to pass in the longitudinal direction of the dosage unit, is inserted. At the outlet end of the dosage unit, a venturi tube is located which clamps the filling and thereby create a nozzle opening that fits the fluids viscosity and the pressure for a given desired dosage. When the dosage unit clogs, a flushing can be obtained by either increasing the pressure of the fluid and thereby forcing a flexible dosage unit to increase the sectional area and allow cleaning or in the same way through a mechanical opening of the dosage unit.

9 Claims, 3 Drawing Sheets

Fig. 1A
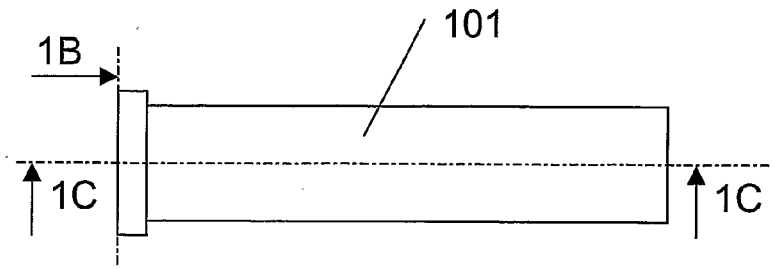
Fig. 1B
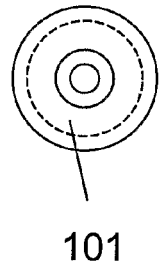
Fig. 1C
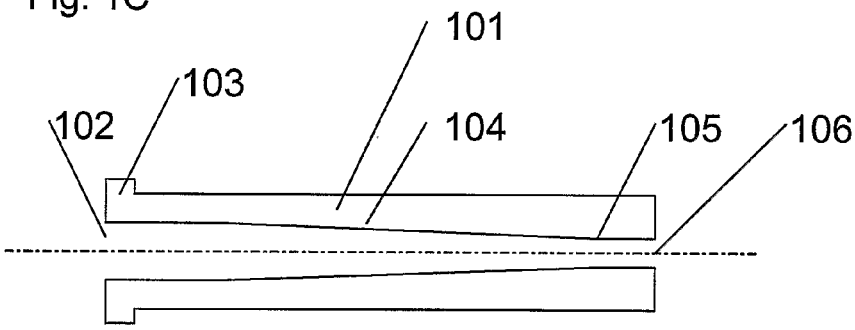
Fig. 1D
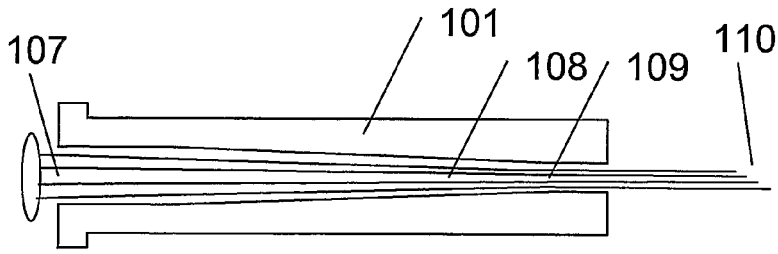
Fig. 1

Fig. 2A
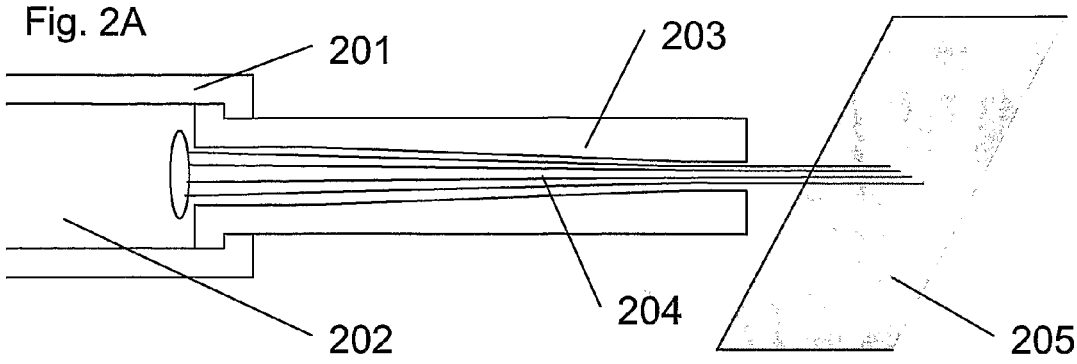
Fig. 2B
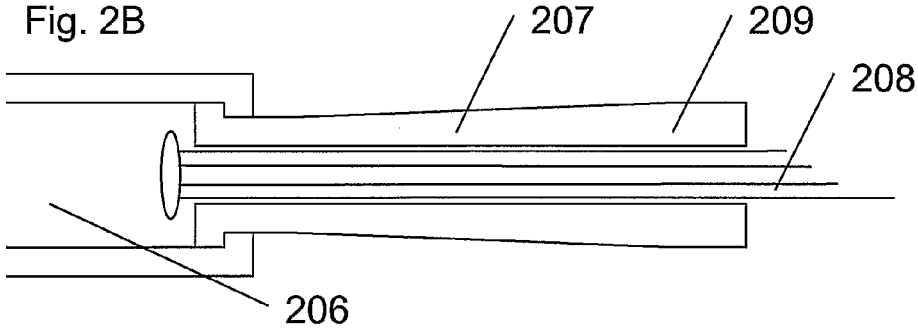
Fig. 2

DEVICE AND A METHOD FOR DOSAGE OF FLUIDS

FIELD OF THE INVENTION

Device and method for continuous, adjustable and self-cleaning dosage of fluids in small quantities under low pressure.

BACKGROUND OF THE INVENTION

Dosage of small quantities of fluids under low pressure is difficult for many reasons. The surface tension of fluids is an especially difficult parameter, if dosage of small quantities of fluids under low pressure is desired.

There are many solutions based on nozzles in a wide sense. Traditional nozzles usually need a relatively high pressure to work continuously and they are sensitive to clogging. When there is a need for small dosage quantities, it is often also necessary to use pulsated dosage (pulsdosing) so that the total quantity of fluid over time becomes sufficiently small.

The present invention is not based on capillary effect that allows fluids to be transported or lifted. The capillary effect is the basic function in patents such as U.S. Pat. No. 4,819,375, FR2088860, U.S. Pat. Nos. 3,786,598, 6,321,487, DE2447230. Patent WO03096796 describes a wick that allows seeping of fluids based on a capillary pull on the fluid from the outlet side and thereby independence of the fluid pressure on the inlet side.

As for the above patents, the present invention is basically also a tube with a filling, but the otherwise well documented correlations between the surface tension of fluids, the design of the nozzle and the pressure on the fluid in traditional nozzles are shifted with the present invention and new advantages can be exploded:

- The formation of drops is avoided and a controlled seeping of fluids is achieved via a hydrostatic pressure on the inlet side
- A precise dosage of fluids under low hydrostatic pressure is possible
- There is not a very high demand for a low particle content in the fluid, as is the case in the prior art solutions mentioned above
- Tolerance to partial clogging and self-cleaning through forward flushing and no need for disassembly of the dosage nozzle as is the case with traditional solutions
- No need for electricity
- The dosage can be adjusted by trimming i.a. the cross sectional area in the venturi tube of the dosage units, the compactness of the filling or the pressure on the inlet side.

The method can preferably be used for reliable dosage of fluids in the manufacturing industry and drip irrigation systems for agricultural use. The precision of the dosage is high and the solution is simple.

SUMMARY OF THE INVENTION

The present invention is a dosage unit, where the inside of the dosage unit is filled with a material, which may be based on organic/non-organic fibres or another material that allows the fluid to pass through. The principle in this dosage unit is to use a small pressure drop from the inlet side to the outlet side to obtain a precise flow of fluid. Except from the hydrostatic over-pressure at the inlet side and the viscosity of the fluid, the flow will be determined by the friction in the dosage unit's venturi tube given by the following parameters:

- The sectional area of the venturi tube of the dosage units
- The overall length of the dosage unit
- The surface characteristics of the dosage unit
- The length of the filling
- The degree of filling in the venturi tube
- The dimension of the filling
- The surface characteristics of the filling
- The flexibility of the filling
- The filling has physical contact with a surface or fluid on the outlet side, so that the formation of drops can be avoided
- The amount of impurities in the filling The dosage unit has a conical shape with a decreasing sectional area from the inlet side towards a venturi tube, where the sectional area is the smallest. In the venturi tube, the sectional area is kept constant over a length of typically 1-10 mm, and this sectional area is the same from this point to the outlet end of the dosage unit. The profile of the cone should preferably be decreasing, so that the inner sides of the dosage unit at the last part of the venturi tube are substantially parallel. With this design more sturdiness and stability in the dosage is achieved. This is because any particles can more easily find room without clogging the dosage unit in a long venturi tube than in a shorter one.

The venturi tube of the dosage unit can be made with a possibility of changing the sectional area mechanically. Thereby a certain desired flow can be depending on the intended use of the dosage unit. The device for this may be adjustable fluently or in pre-determined steps, corresponding to specific quantities of flow. An example for a fluent adjustment could be a clamp placed around the outlet end of a conical dosage unit made of a flexible material. By tightening the clamp, the venturi tube and the filling are compressed and the quantity of fluid that can pass is thereby decreased.

The filling material extends at least from the biggest opening of the nozzle structure, past the venturi tube of the dosage unit and beyond the outlet end of the dosage unit. In the smallest sectional area of the venturi tubes, the filling will—depending on the choice of material—consist of a number of small channels that allow a certain amount of fluid to pass. Hereby, a very small volume in the venturi tube is achieved for the flow of fluid, and furthermore the small dimensions of each channel will ensure an almost laminar-flow in the dosage unit. In this way, a friction pattern is created in the dosage unit that allows a precise dosage, which is independent of a capillary effect.

The dosage unit and the filling must be made of a suitable material in relation to the fluid and the environment, in which it is supposed to work. The dosage unit may be made of plastic, rubber or a likewise flexible material or of a non-flexible material (e.g. plastic, metal, ceramics).

When the dosage unit is made of a flexible material, the cleaning of the dosage unit can be carried out by periodically increasing the pressure on the fluid, so that the dosage unit gives way at the narrowest point, thus increasing the sectional area and allowing impurities to be flushed out. When the dosage unit is made from a non-flexible material, a mechanical device must similarly be included in the design to allow an increase of the sectional area of the venturi tube of the dosage unit and thus to allow flushing.

In combination with a periodic increase of pressure in the fluid, the forward flushing of the dosage unit can take place by adding cleaning additives to the fluid.

Furthermore, the cleaning may take place by periodically adding gasses under pressure to the fluid, so that a mechanical cleaning of the filling of the dosage unit is obtained as well.

The cleaning may be further improved by a mechanical actuation of the dosage unit during the periodic forward flushing by mechanical manipulation of the outside of the dosage unit.

By means of this invention, the dosage of fluid may be determined very accurately, even at very low pressure drops (down to say 0.1 bar), over the venturi tube of the dosage unit.

In order to minimise/avoid the formation of drops when the fluid leaves the venturi tube of the dosage unit, it is important that the filling extends past the outlet end of the dosage unit and is in contact with another surface or fluid. Hereby, the fluid can seep out through the filling without creating drops.

Also, it is an advantage—but not mandatory—that the dosage unit, after the venturi tube, ends in an oblique cut off. This results in a decrease of the adherence of the fluid. In the same way, easy passage of the fluid can be enhanced by letting the filling be cut off in an oblique angle at the inlet side. In this way, any air/gas bubbles in the fluid will be more easily broken and be allowed to pass through. Another way to break any air/gas bubbles is to let some of the fibres project into the feeding pipe of the dosage unit in order to puncture the air bubbles and thereby allow passage.

The filling will typically be non-organic fibres. The diameter of the fibres will vary from case to case but will typically be between 0.006-0.5 mm. The filling may be of any material that will add characteristics to or influence the fluid flowing through it. In this way, a controlled degrading/dissolving of the filling may be interesting, if the fluid is to be added to a chemical substance, of which the filling is made. An example of this is the discharge of fertilizer into water when the dosage unit is used for agricultural purposes. The fertilizer may be delivered in solid form such as pills or in fibres that are placed in the dosage units as a filling. As the fertilizer is dissolving, the sectional area of the dosage unit and thus the quantity of water delivered is increased, which can be adapted for the ever increasing need for water of the plants getting still bigger. In the same way the filling may be made of a material that affects the fluid thermically and/or chemically. Examples of this can be thermically heated filling for heating of the fluid, chemical restriction of, e.g., pesticides by means of carbon fibres.

The filling may for example consist of round fibres with more or less smooth surfaces. The smaller the diameter, and the rougher the surface of the fibre, the bigger the friction. A typical polyester or polypropylene fibre that comes with different surface roughness may be a preferred fibre.

The filling may be made of more than one material having different dimensions. In this way a core of the filling could consist of a thermally heated fibre, whilst the fibres in the venturi tube contains silver ions to be released slowly to the fluid.

The device or method will typically be used for dosage in the range of 1-5000 ml per hour. In the low end of the dosage spectrum, the dosage method will have many advantages compared to other solutions.

The device for small quantities (10-500 ml/hour) will typically be 30 mm long and 6 mm in outer diameter. For larger quantities (500-1000 ml/hour), the size will typically be 40 mm long and 8 mm in outer diameter. For large quantities, the size will typically be 60 mm long and 10 mm in outer diameter. The sectional area of the venturi tube of the above mentioned dosage units will typically be between 0.75 and 20 $mm^2$. Of course, these dimensions are only intended as a guide, as considerations regarding the fitting in of the dosage unit and choice of material can make the dosage units bigger or smaller.

BRIEF DESCRIPTION OF THE DRAWINGS

FIG. 1 presents a dosage unit with a cross section showing the conical shape FIG. 2 presents a dosage unit at normal pressure and at higher pressure on the inlet side

DETAILED DESCRIPTION OF PREFERRED EMBODIMENTS

Figure 3:
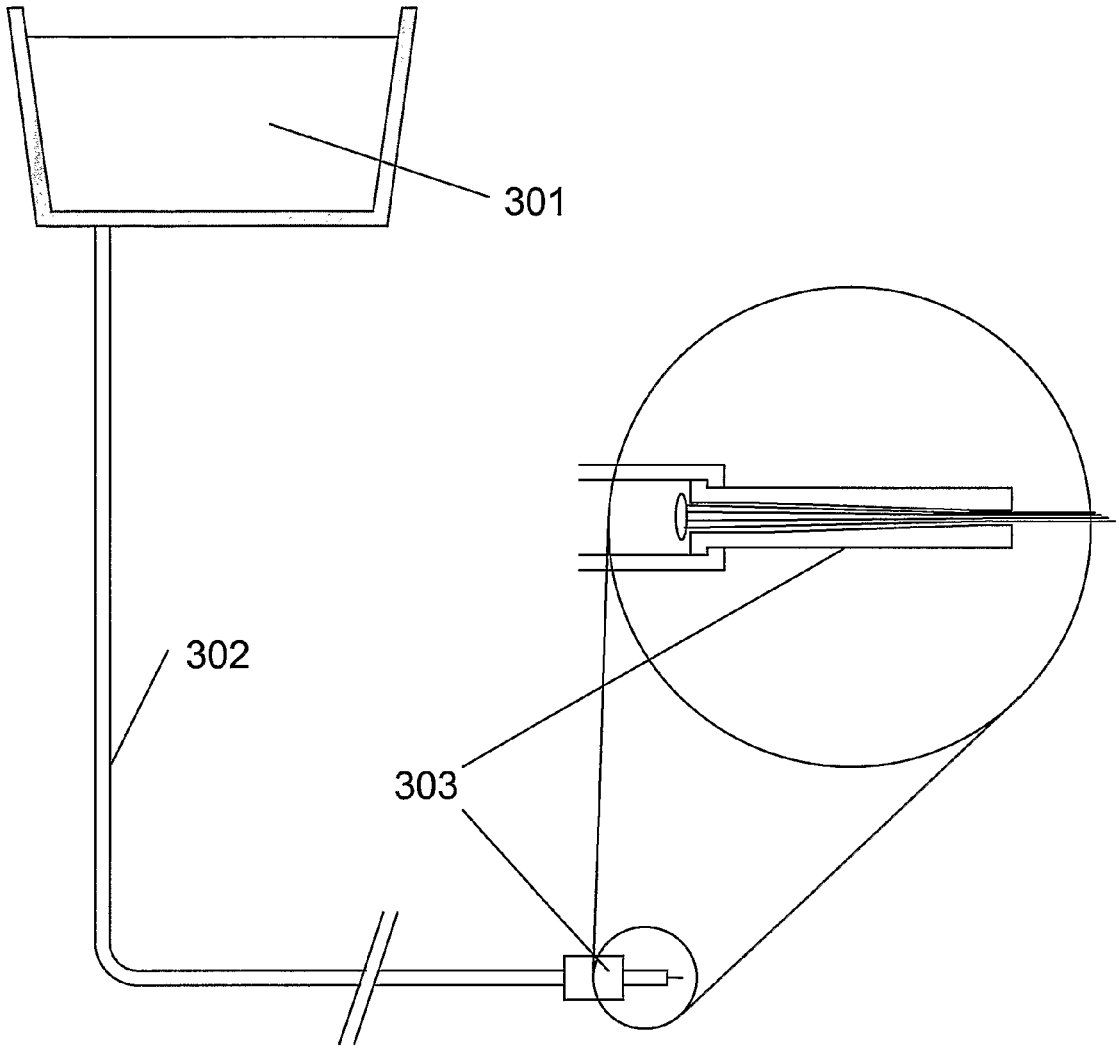
FIG. 3 presents a conceptual installation of a dosage unit for dosage purposes

FIG. 1 illustrates a conceptual design of the present dosage unit.

FIG. 1A shows a dosage unit 101 seen from the side with lines for illustrating the cross-sections of FIGS. 1B and 1C. FIG. 1B shows the dosage unit 101 seen from the inlet side.

FIG. 1C shows a cross section of the centre of the dosage unit 101. The dosage unit 101 has an inlet 102 at one end and an outlet 106 at the opposite end 106. The direction of the fluid flow will always be from the inlet 102 towards the outlet 106. The dosage unit 101 has a flange 103 at the inlet 102 that allows securing of the dosage unit. Internally, the dosage unit 101 has a conical profile 104, after which the dosage unit terminates in a venturi tube 105 at the outlet end 106 of the dosage unit.

FIGS. 1A and 1B show a rotary symmetrical tube shaped dosage unit, but it might as well be two sheets with a cross section as shown in FIG. 1C, where their longitudinal axis extends perpendicularly to the plane of the drawing. Together the two sheets will delimit a venturi shaped cross section corresponding to the cross section of the conical tube.

FIG. 1D corresponds to the cross sectional view of the dosage unit of FIG. 1C, but now with a filling 108 in the dosage unit 101. The filling is fixed to the extend necessary at the dosage unit's inlet 102. The filling 108 will have the same volume anywhere in the dosage unit between the inlet and the outlet, but will be more compressed in the venturi tube 109 of the dosage unit. Note that the filling 108, after the outlet of the dosage unit, is cut off with different lengths 110 in order to eliminate the potential formation of drops.

FIG. 2 shows the present dosage unit during normal operation and during flushing.

FIG. 2A shows a dosage unit 203 with filling 204 attached to a fluid supply 201 with a fluid chamber 202. After the outlet of the dosage unit, the filling 204 is in contact with a surface 205 meant to receive the fluid. The hydrostatic pressure will be bigger in the fluid chamber 202 than after the outlet of the dosage unit.

FIG. 2B shows a dosage unit 207 being supplied with fluid 206 at, for example, 1 bar, whereby the flexible material of the dosage unit will give way and the venturi tube 209 of the dosage unit will be expanded. The increased cross sectional area of the venturi tube 209 of the dosage unit 207 allows any impurities in the filling 208 to pass the part of the filling in the venturi tube 209, which is the most compact, under normal pressure (e.g., 0.2 bar). In the same way, an increase of the venturi tube of the dosage unit in the sheet version (see description of FIGS. 1A and 1B) is achieved by moving the sheets away from one another.

FIG. 3 shows a dosage unit 303 connected to a fluid supply from a fluid reservoir 301 via a connecting hose 302. The sizing of the connecting hose 302 provides a constant supply of fluid to the dosage unit 303 at a given pressure.

The invention claimed is:

1. A dosage unit with an internal, from an inlet toward and outlet, tapering cross section that ends in a venturi tube at the outlet of the dosage unit and where a filling extends in a longitudinal direction of in the dosage unit at least through all of the venturi tube and beyond the outlet of the dosage unit, the filling being attached at the inlet, where the dosage unit causes a friction controlled hydrostatic pressure drop from the inlet to the outlet, and where the dosage unit comprises means for increasing a sectional area of the venturi tube, where the venturi tube is made of a solid material and with an adjustable sectional area of the venturi tube to allow a larger or smaller flow of fluid through the adjustable sectional area with the filling.

2. A dosage unit according claim 1, where the profile of the outlet is obliquely cut off.

3. A dosage unit according claim 1, where the filling is replaceable.

4. A dosage unit according claim 1, where the filling is longer than the dosage unit.

5. A dosage unit according to claim 1, with a filling that is degraded or worn down over time in a controlled manner.

6. A dosage unit according claim 1, where the filling affects the fluid thermically and/or chemically.

7. A dosage unit according to claim 1, where the filling consists of two or more different materials.

8. A dosage unit with an internal, from an inlet toward and outlet, tapering cross section that ends in a venturi tube at the outlet of the dosage unit and where a filling extends in a longitudinal direction of in the dosage unit at least through all of the venturi tube and beyond the outlet of the dosage unit, the filling being attached at the inlet, where the dosage unit causes a friction controlled hydrostatic pressure drop from the inlet to the outlet, where the dosage unit comprises means for increasing a sectional area of the venturi tube, and including means for periodical forward flushing by increasing the sectional area of the venturi tube through increasing the pressure on the inlet side and/or through mechanical opening of the geometry of the venturi tube.

9. A dosage unit with an internal, from an inlet toward and outlet, tapering cross section that ends in a venturi tube at the outlet of the dosage unit and where a filling extends in a longitudinal direction of in the dosage unit at least through all of the venturi tube and beyond the outlet of the dosage unit, the filling being attached at the inlet, where the dosage unit causes a friction controlled hydrostatic pressure drop from the inlet to the outlet, where the dosage unit comprises means for increasing a sectional area of the venturi tube, and including means for periodical forward flushing by moving the filling in relation to the venturi tube along their common longitudinal axis.

* * * * *